US010926426B2

(12) United States Patent
Psimadas et al.

(10) Patent No.: US 10,926,426 B2
(45) Date of Patent: Feb. 23, 2021

(54) RECONFIGURABLE SHAVING RAZORS WITH ARTICULATING HEAD

(71) Applicant: BIC-VIOLEX SA, Anixi (GR)

(72) Inventors: Ioannis-Marios Psimadas, Athens (GR); Eric-Thierry Loiseau, Castellanza (IT)

(73) Assignee: BIC-VIOLEX SA, Anixi (GR)

( * ) Notice: Subject to any disclaimer, the term of this patent is extended or adjusted under 35 U.S.C. 154(b) by 93 days.

(21) Appl. No.: 16/309,683

(22) PCT Filed: Jul. 8, 2016

(86) PCT No.: PCT/IB2016/001111
§ 371 (c)(1),
(2) Date: Dec. 13, 2018

(87) PCT Pub. No.: WO2018/007845
PCT Pub. Date: Jan. 11, 2018

(65) Prior Publication Data
US 2019/0255721 A1 Aug. 22, 2019

(51) Int. Cl.
*B26B 21/52* (2006.01)

(52) U.S. Cl.
CPC ..... *B26B 21/521* (2013.01); *B26B 21/523* (2013.01)

(58) Field of Classification Search
CPC ..... B26B 21/00; B26B 21/52; B26B 21/521; B26B 21/522; B26B 21/523; B26B 21/525; B26B 21/526; B26B 21/527
USPC ..... 30/526
See application file for complete search history.

(56) References Cited

U.S. PATENT DOCUMENTS

| | | | | |
|---|---|---|---|---|
| 1,633,139 | A * | 6/1927 | Staats-Oels | B26B 21/22 30/50 |
| 4,461,078 | A * | 7/1984 | Carreker | B26B 21/40 30/47 |
| 5,093,991 | A * | 3/1992 | Hendrickson | B26B 21/28 30/531 |
| 5,167,069 | A * | 12/1992 | Quinn | B26B 21/523 30/527 |
| 5,787,594 | A * | 8/1998 | Estrada | B26B 21/28 30/527 |
| 7,103,980 | B2 * | 9/2006 | Leventhal | B26B 19/00 30/211 |
| 7,185,436 | B2 * | 3/2007 | Murphy | A47J 17/02 30/123.6 |
| 7,270,129 | B1 * | 9/2007 | Rehkemper | A61C 17/225 132/322 |

(Continued)

FOREIGN PATENT DOCUMENTS

| | | |
|---|---|---|
| DE | 296 21 890 U1 | 3/1997 |
| GB | 2476096 A | 6/2011 |
| WO | 2006/007874 A1 | 1/2006 |

OTHER PUBLICATIONS

International Search Report for PCT/IB2016/001111; dated Feb. 6, 2017.

*Primary Examiner* — Andrea L Wellington
*Assistant Examiner* — Richard D Crosby, Jr.
(74) *Attorney, Agent, or Firm* — Polsinelli PC

(57) ABSTRACT

A shaving razor having a head and a first handle to provide a first use configuration with the first handle operable to be rotatably secured to a second handle to provide a second use configuration of the shaving razor with an articulating head.

17 Claims, 9 Drawing Sheets

(56) References Cited

U.S. PATENT DOCUMENTS

| | | | | |
|---|---|---|---|---|
| 7,415,769 | B2 * | 8/2008 | Hughes | A47J 17/02 15/111 |
| 7,856,725 | B2 * | 12/2010 | Marut | B26B 21/523 30/527 |
| 8,387,259 | B2 | 3/2013 | Starr | |
| 8,938,885 | B2 * | 1/2015 | Stevens | B26B 21/52 30/527 |
| 8,978,258 | B2 * | 3/2015 | Patel | B26B 21/4093 30/527 |
| 9,032,631 | B2 * | 5/2015 | Christie | B26B 21/521 30/527 |
| 9,132,560 | B2 * | 9/2015 | Shimizu | B26B 19/063 |
| 9,144,912 | B2 * | 9/2015 | Marut | F16C 11/10 |
| 9,889,572 | B2 * | 2/2018 | Bucco | B26B 21/521 |
| 9,902,078 | B2 * | 2/2018 | Lopez | B26B 21/521 |
| 9,931,755 | B2 * | 4/2018 | Gilor | B26B 21/44 |
| 10,405,685 | B2 * | 9/2019 | Wong | A47J 17/02 |
| 10,406,704 | B2 * | 9/2019 | Barrett | B26B 21/16 |
| 10,493,643 | B1 * | 12/2019 | Dryfhout | B26B 21/4081 |
| 10,500,744 | B1 * | 12/2019 | Dryfhout | B26B 21/125 |
| 10,543,609 | B2 * | 1/2020 | Dryfhout | B26B 21/4031 |
| D874,726 | S * | 2/2020 | Everard | D28/46 |
| 2006/0053632 | A1 * | 3/2006 | Khubani | B26B 19/02 30/208 |
| 2011/0138637 | A1 * | 6/2011 | Bucco | B26B 21/521 30/527 |
| 2012/0291295 | A1 * | 11/2012 | Braun | B26B 21/52 30/531 |
| 2014/0123506 | A1 * | 5/2014 | Gaines | B26B 21/52 30/526 |
| 2015/0183119 | A1 * | 7/2015 | Contaldi | B26B 21/527 132/200 |

* cited by examiner

RECONFIGURABLE SHAVING RAZORS WITH ARTICULATING HEAD

CROSS REFERENCE TO RELATED APPLICATION

This application is a National Stage application of International Application No. PCT/IB2016/001111, filed Jul. 8, 2016, and published as WO 2018/007845 on Jan. 11, 2018, the entire contents of which are incorporated herein by reference.

BACKGROUND

1. Field

The following description relates to shaving razors. A shaving razor may include a head with one or more blades and a handle for manipulating the head while using the shaving razor. For example, a shaving razor may include a head with one or more blades secured to a first handle to provide a first configuration of the shaving razor, and the first handle may be operable to be rotatably secured to a second handle to provide a second configuration of the shaving razor with an articulating head.

2. Description of Related Art

Conventional shaving razors provide a single configuration irrespective of whether such are in use or in storage, which is disadvantageous if storage space is limited, e.g., in a suitcase or travel bag. Further, the single configuration prevents such conventional shaving razors from accommodating differing user preferences, which is disadvantageous if a user has preferences that are not addressed by the single configuration.

SUMMARY

The present disclosure provides a shaving razor that overcomes the aforementioned disadvantages of conventional shaving razors. The shaving razor of the present disclosure generally includes a first handle to provide a first use configuration of the shaving razor. The first handle is operable to be rotatably secured to a second handle via a connector to provide a second use configuration of the shaving razor. The connector is operable to permit the head and first handle to be reconfigured, e.g., tilted or rotated, relative to the second handle, thereby providing a variety of different use configurations of the shaving razor, i.e., multidirectional shaving. The connector is further operable to permit the head and first handle to be selectively detached from and attached to the second handle to reduce a size of the shaving razor and allow use of the head and first handle without the second handle, i.e., a miniaturized shaving razor.

The aforementioned may be achieved in an aspect of the present disclosure by providing a shaving razor having a plurality of use configurations. The shaving razor may include a head having at least one blade and a handle rotatably secured to the head via a connector. The connector may be operable to allow the head to rotate or pivot relative to the handle. The connector may include a first connector or a male portion and a second connector or a female portion. The female portion may be operable to at least partially receive the male portion. The female portion may include an aperture that extends at least partially through the handle. The male portion may include (i) at least one arm operable to be received in the aperture, and/or (ii) a dome operable to be received in the aperture. The male portion may include a circumferential abutment surface at least partially surrounding the at least one arm or the dome. The at least one arm and/or the dome defines an axis of rotation. The head may include another handle between the head and the connector. The handle and the another handle may be aligned by the connector to extend in (i) a parallel direction in a first use configuration, and/or (ii) a non-parallel direction in a second use configuration. The connector may be operable to permit the handle to detach from the another handle to provide a third use configuration. At least a portion of the connector may be resilient. The connector may be operable to detachably secure the head to the handle via a snap-fit engagement. The connector may provide and/or define a pivot range between the head and the handle. The pivot range may be between zero (0) and ninety (90) degrees and/or between zero (0) and negative ninety (−90) degrees. Zero (0) degrees may be defined as when the head extends perpendicular to the handle.

The aforementioned may be achieved in another aspect of the present disclosure by providing a reconfigurable shaving razor. The shaving razor may include a first component including a shaver head, a first gripping surface, and/or a first portion of a connector. The shaving razor may include a second component including a second gripping surface and/or a second portion of the connector. The connector may be operable to allow the first component to assume various configurations while the first component is secured to the second component. The connector may provide a pivot range between the first component and the second component. The pivot range may be between zero (0) and ninety (90) degrees and/or between zero (0) and negative ninety (−90) degrees. 0 degrees may be defined as when the first component extends parallel to the second component. 16. The shaving razor may include a male portion on the first component, and a female portion on the second component. The female portion may include an interior abutment surface and/or an exterior abutment surface. The male portion may include a surface operable to abut the interior abutment surface and the exterior abutment surface of the female portion. The shaving razor may include an end of the second component operable to nest within a portion of the first component. The male portion may (i) define an axis of rotation, and/or (ii) include a ledge that defines one or more maximum limits of the axis of rotation.

The aforementioned may be achieved in another aspect of the present disclosure by providing a shaving razor with a first component and a second component. The first component may include (i) a first component end with a shaver head, (ii) another first component end with a portion of a connector extending from the first component, and/or (iii) a first elongated gripping surface extending between the first component end and the another first component end. The second component may include (i) a second component end with an aperture extending at least partially through the second component, and/or (ii) a second elongated gripping surface extending between the second component end and another second component end. The connector may be operable to (i) rotatably secure the first component to the second component, (ii) allow the first component to assume a plurality of use configurations while the first component is secured to the second component, and/or (iii) allow the first component to assume another use configuration while the first component is separated from the second component.

The foregoing is intended to be illustrative and is not meant in a limiting sense. Many features of the embodiments may be employed with or without reference to other features of any of the embodiments. Additional aspects, advantages, and/or utilities of the present disclosure will be set forth in part in the description that follows and, in part, will be apparent from the description, or may be learned by practice of the present disclosure detailed therein.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present disclosure is not limited to the precise embodiments and features shown. The accompanying drawings, which are incorporated in and constitute a part of this specification, illustrate an implementation of apparatuses consistent with the present disclosure and, together with the description, serve to explain advantages and principles consistent with the present concepts detailed herein.

DETAILED DESCRIPTION

Figure 1:
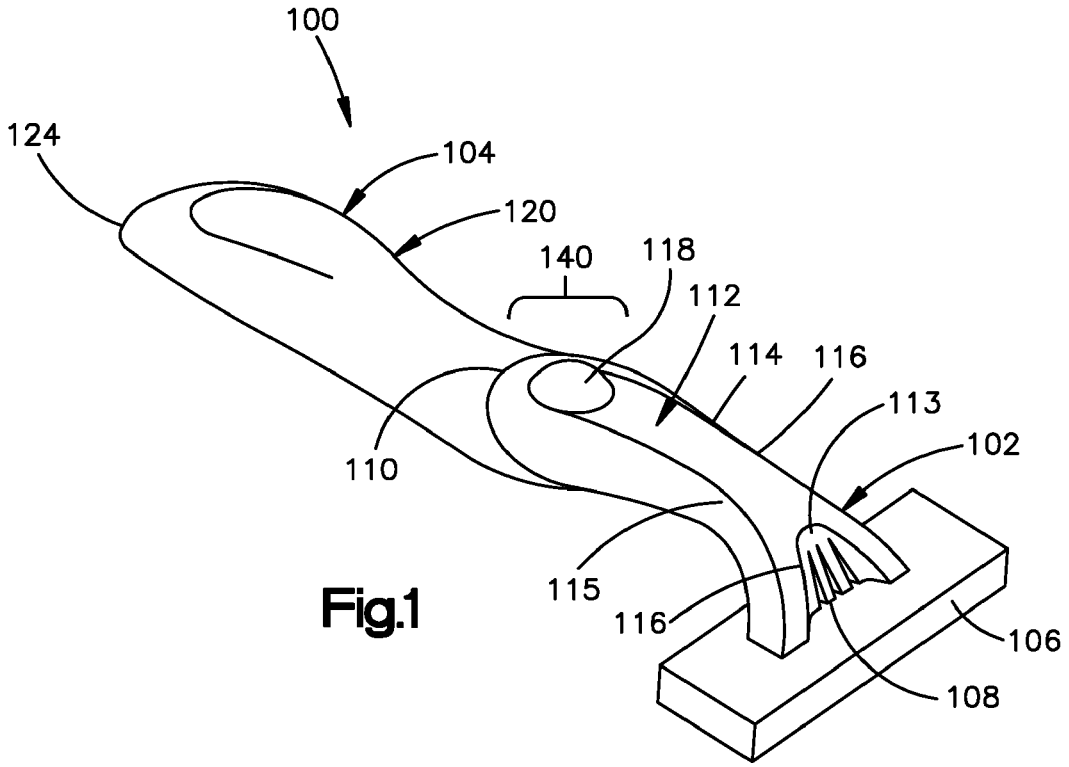
FIG. 1 is a diagram illustrating a perspective view of a shaving razor with a first handle detachably secured to a second handle.

It is to be understood that the present disclosure is not limited in its application to the details of construction and to the embodiments of the components set forth in the following description or illustrated in the drawings. The figures and written description are provided to teach any person skilled in the art to make and use the inventions for which patent protection is sought. The present concepts detailed herein are capable of other embodiments and of being practiced and carried out in various ways. Persons of skill in the art will appreciate that the development of an actual commercial embodiment incorporating aspects of the present disclosure will require numerous implementations—specific decisions to achieve the developer's ultimate goal for the commercial embodiment. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present disclosure or the appended claims. Further, it should be understood that any one of the features of the present disclosure may be used separately or in combination with other features. Other systems, methods, features, and advantages of the present disclosure will be, or become, apparent to one with skill in the art upon examination of the figures and the detailed description. It is intended that all such additional systems, methods, features, and advantages be included within this description, be within the scope of the present disclosure, and be protected by the accompanying claims.

Further, any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 3 mm includes all values from 1 mm to 9 mm, and approximately 50 degrees includes all values from 16.6 degrees to 150 degrees.

Further, as the present disclosure is susceptible to embodiments of many different forms, it is intended that the present disclosure be considered as an example of the principles of the present concepts and not intended to limit the present concepts to the specific embodiments shown and described. Any one of the features of the present disclosure may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present disclosure may include a variety of combinations and/or integrations of the embodiments described herein. Additionally, all aspects of the present disclosure, as described herein, are not essential for its practice. Likewise, other systems, methods, features, and advantages of the present disclosure will be, or become, apparent to one with skill in the art upon examination of the figures and the description. It is intended that all such additional systems, methods, features, and advantages be included within this description, be within the scope of the present disclosure, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

Turning to FIGS. 1-8, a shaving razor 100 is illustrated, which generally includes a body with two elongated components, i.e., an upper end component 102 and a lower end component 104 are detachably secured together to provide a plurality of different use configurations as illustrated by FIGS. 5-8. In the exemplary embodiment, an overall size of the upper end component 102 is smaller than that of the lower end component 104. The upper end component 102 extends along a first axis Y1. The upper end component 102 is sized, shaped, and operable to function as a miniature or pocket-side handle to facilitate use of the shaving razor 100 when the upper end component 102 is detached from the lower end component 104. The lower end component 104 extends along a second axis Y2. The lower end component is sized, shaped, and operable to function as an extension handle to facilitate use of the shaving razor 100 when the upper end component 102 is attached to the lower end component 104. The upper end component 102 includes a shaver head 106 secured to an end 108 that is opposite to the lower end component 104. In the exemplary embodiment, the shaver head 106 is permanently secured to the upper end component 102, with a fixed orientation thereto, but it is foreseen that the shaver head 106 may be detachably secured to the upper end component 102 and/or pivotably or rotatably secured to the upper end component 102 without deviating from the scope of the present disclosure. The shaver head 106 houses a plurality of blades 109 and preferably includes at least one blade with a cutting edge 111 and/or up to ten blades. The cutting edge 111 extends longitudinally along a blade axis X. The blade axis X is perpendicular to the first axis Y1 of the upper end component 102. It is foreseen that the shaving head 106 may include a plurality of additional components, e.g., a guard bar and a cap, on either side of the plurality of blades 109, a lubrication strip, and/or a plurality of fins without deviating from the scope of the present disclosure.

Figure 2:
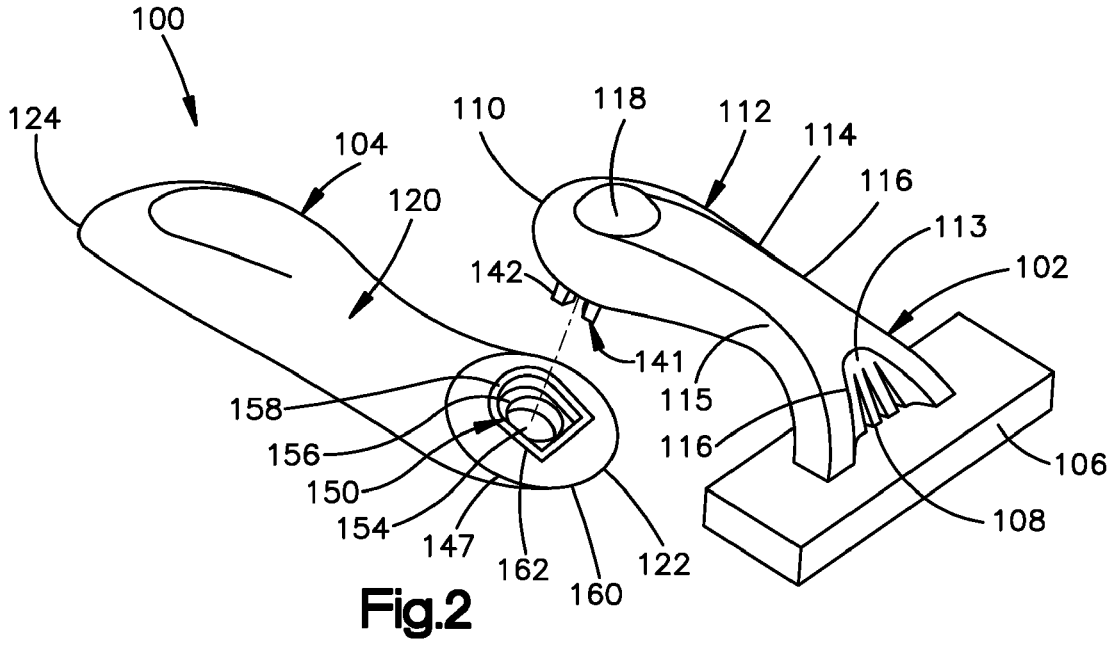
FIG. 2 is a diagram illustrating a perspective view of the shaving razor shown in FIG. 1 with the first handle detached from the second handle.

Opposite to the end 108 of the upper end component 102 is a rounded end 110 that forms a portion of a first handle or a first grip 112. It is foreseen that the end 110 of the upper end component 102 could be any shape, e.g., cylindrical, without deviating from the scope of the present disclosure. The grip 112 is defined by exterior surfaces of a plurality of intersecting features with different contours that collaboratively allow a user of the shaving razor 100 to securely grip and handle, or manipulate the shaving razor 100 when the shaving razor 100 is in another use configuration as illustrated by FIG. 2. The grip 112 includes a depressed portion 113 with shoulders 114, 115 on sides thereof. Each of the shoulders 114, 115 extends along the upper end component 102 from the shaver head 106 and the end 108, and meets at a point adjacent to the end 110 of the upper end component 102. The depressed portion 113 defines a ledge 116, which extends entirely around the depressed portion 113 on the upper end component 102 and between the shoulders 114, 115. The ledge 116 also forms part of the grip 112. Between the shoulders 114, 115 is a raised surface 118 that also forms part of the grip 112 and part of the end 110. In the exemplary embodiment, the surface 118 is dome shaped, generally annular, and defines an axis of rotation. It is foreseen, however, that the surface 118 may be formed in one or more other shapes including, but not limited to, oval, rectangle, square, or a combination thereof, without deviating from the scope of the present disclosure.

The lower end component 104 includes a second handle or a second grip 120. Similar to the grip 112 of the upper end component 102, the grip 120 is defined by exterior surfaces of a plurality of intersecting features with different contours that collaboratively allow the user of the shaving razor 100 to securely grip and handle, or manipulate, the shaving razor 100 when the shaving razor 100 is in the use configuration as illustrated by FIG. 1. The grip 120 extends along an entire length of the lower end component 104 and between ends 122, 124 of the lower end component 104.

In the exemplary embodiment, the exterior surfaces of the grips 112, 120 are generally smooth. It is foreseen, however, that a plurality of friction-enhancing surface features may be formed on one or more of the exterior surfaces of the grip 112 and/or the grip 120 without deviating from the scope of the present disclosure. The friction-enhancing surface features provide a surface texture that is operable to improve of the ability to grip the shaving razor 100.

A connection means or connector 140 is formed on a portion of each of the upper end component 102 and the lower end component 104. On the upper end component 102, the connector 140 includes a first connecting portion or male portion 141 adjacent to the end 110 of the upper end component 102. The male portion 141 includes a plurality of arms 142 that extend from an underside of the raised surface 118. Each of the plurality of arms 142 is positioned on a raised upper platform 144 that extends from an upper base 146 of the male portion 141. In the exemplary embodiment, the plurality of arms 142 includes four arms that are spaced equidistant from each other about the platform 144 thereby forming a circle and an axis of rotation. It is foreseen, however, that the shaver 100 may be designed with any number of the plurality of arms 142, e.g., one to six, and/or form any shape, e.g., oval, rectangle, square, or a combination thereof, without deviating from the scope of the present disclosure. The male portion 141 includes a ledge 147, which extends entirely around the base 146 and defines an outermost edge of a circumferential upper abutment surface 148 of the male portion 141.

Figure 3:
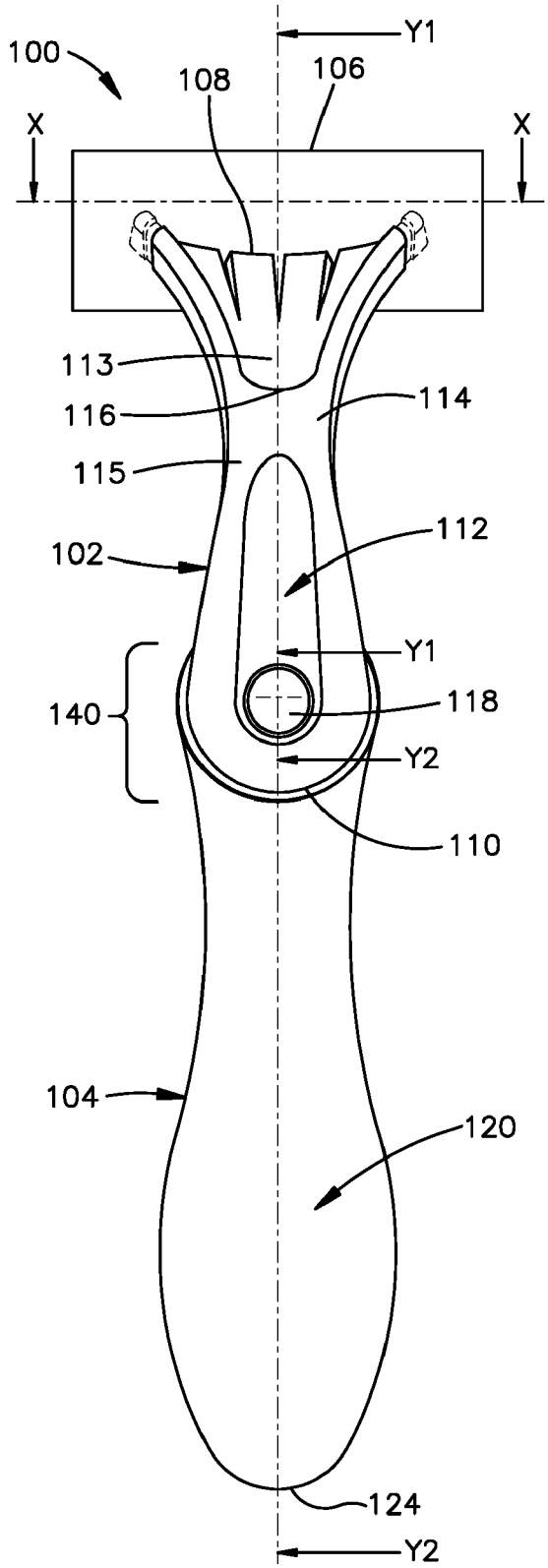
FIG. 3 is a diagram illustrating a top plan view of the shaving razor of FIG. 1.
Figure 4:
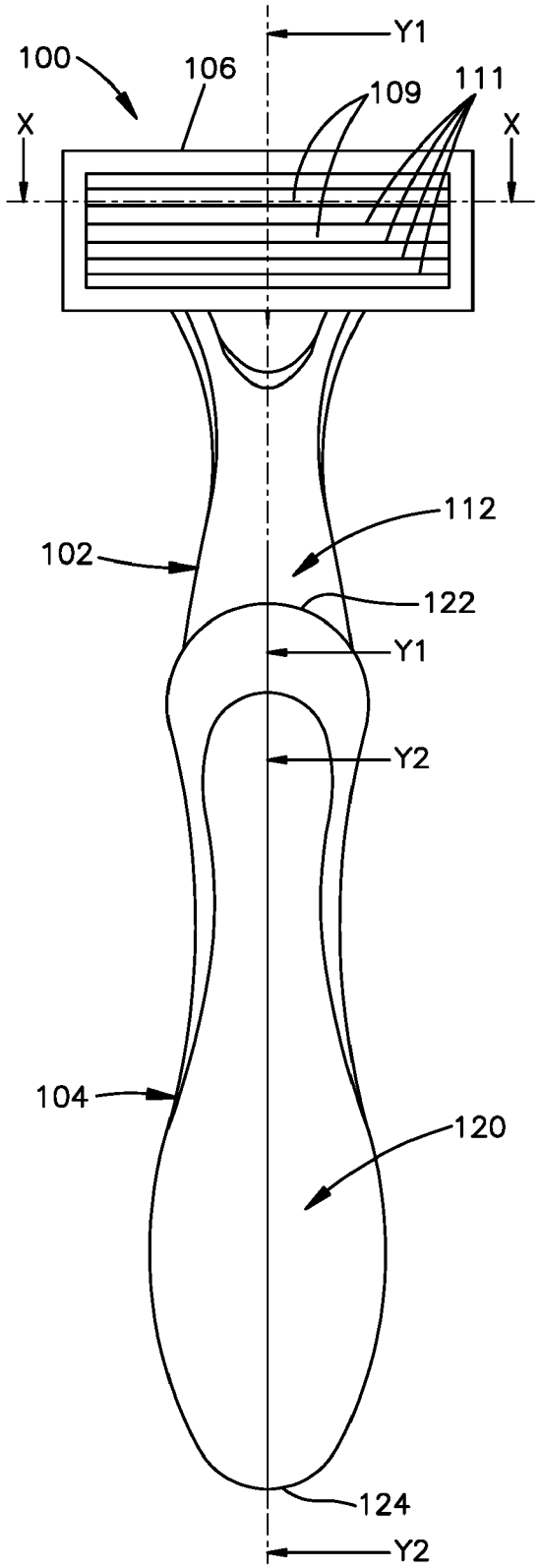
FIG. 4 is a diagram illustrating a bottom plan view of the shaving razor of FIG. 1.
Figure 5:
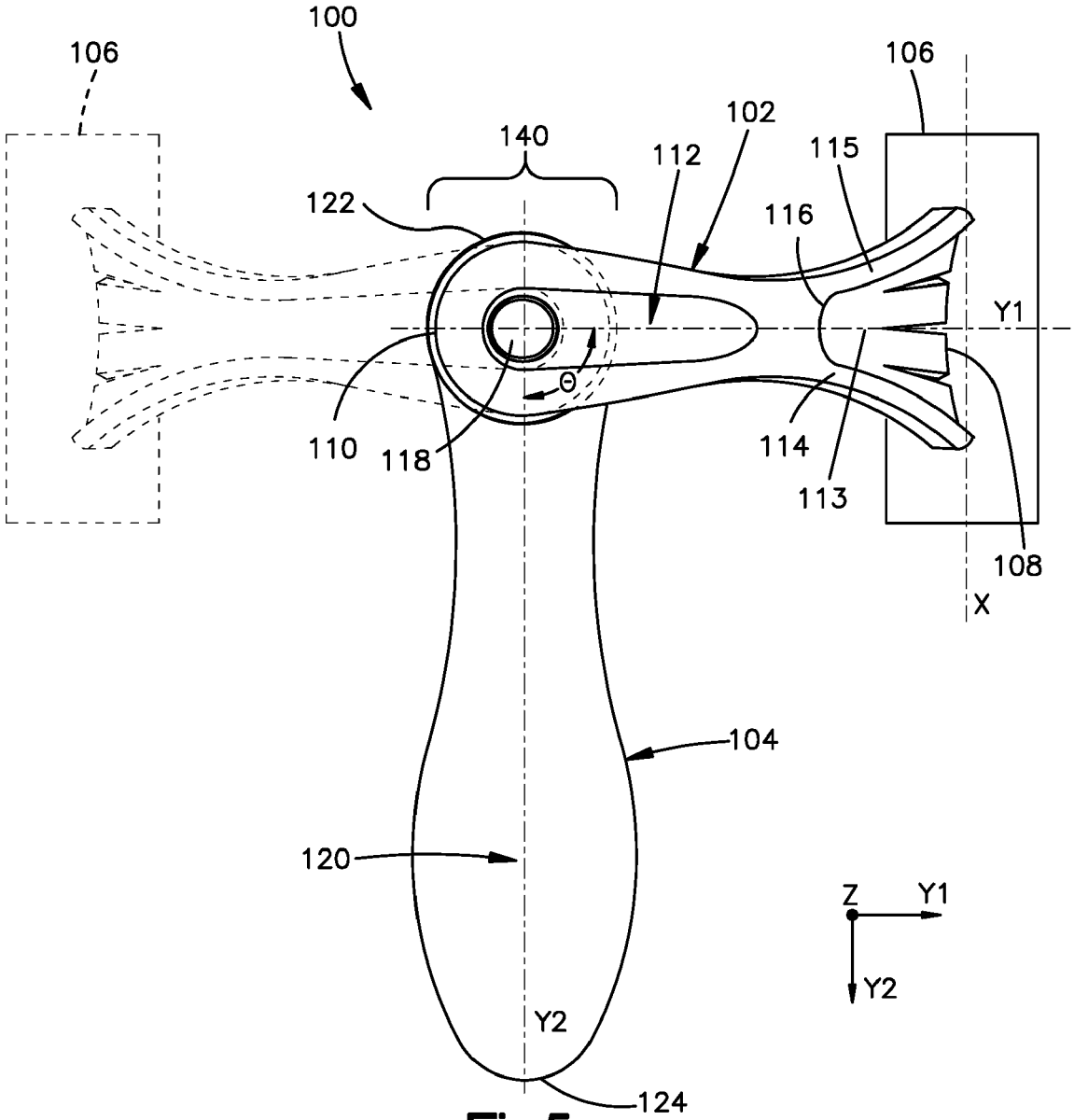
FIG. 5 is a diagram illustrating a top plan view of the shaving razor of FIG. 1 in another configuration.
Figure 6:
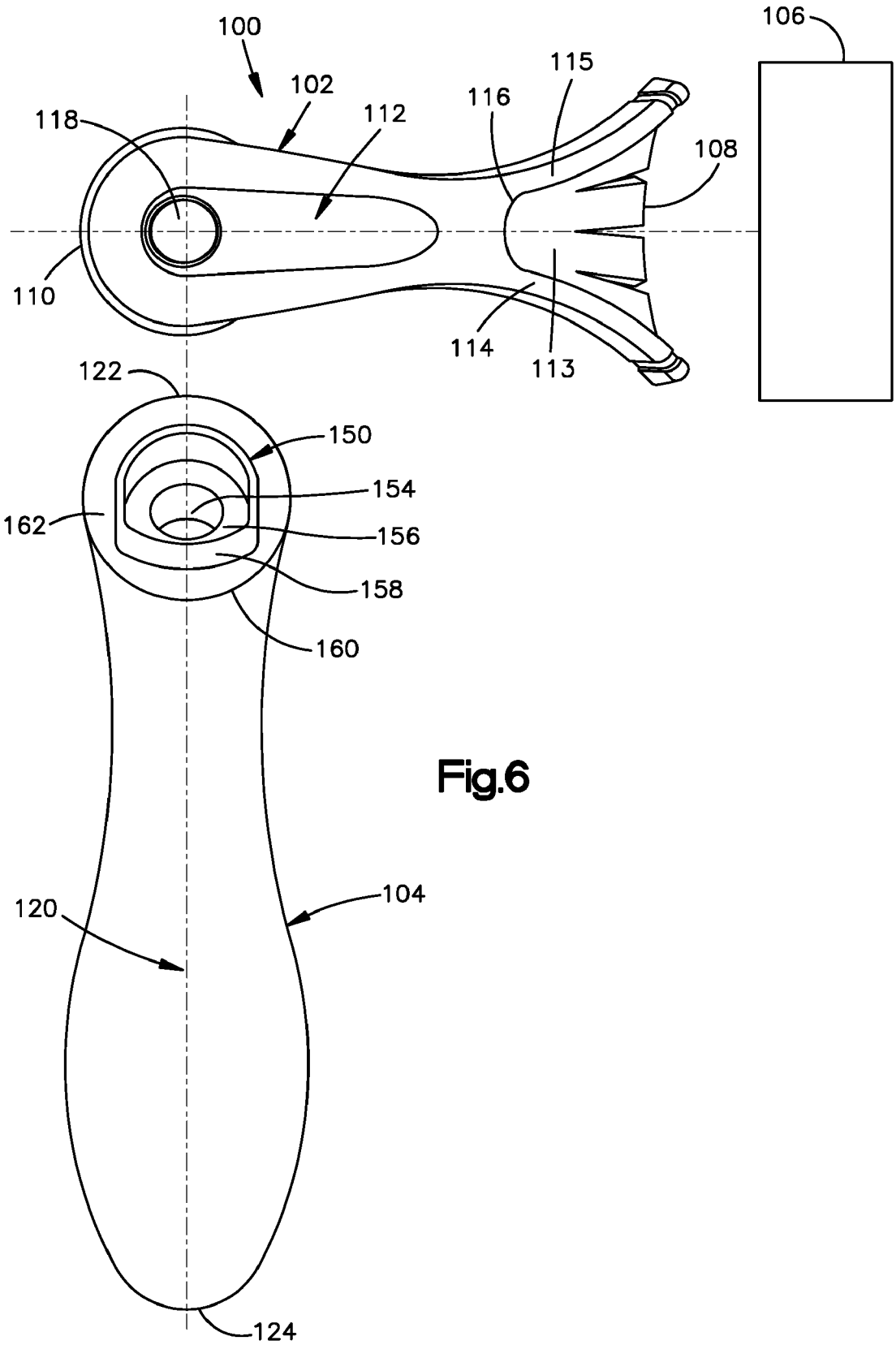
FIG. 6 is an exploded top plan view of the shaving razor of FIG. 5.
Figure 7:
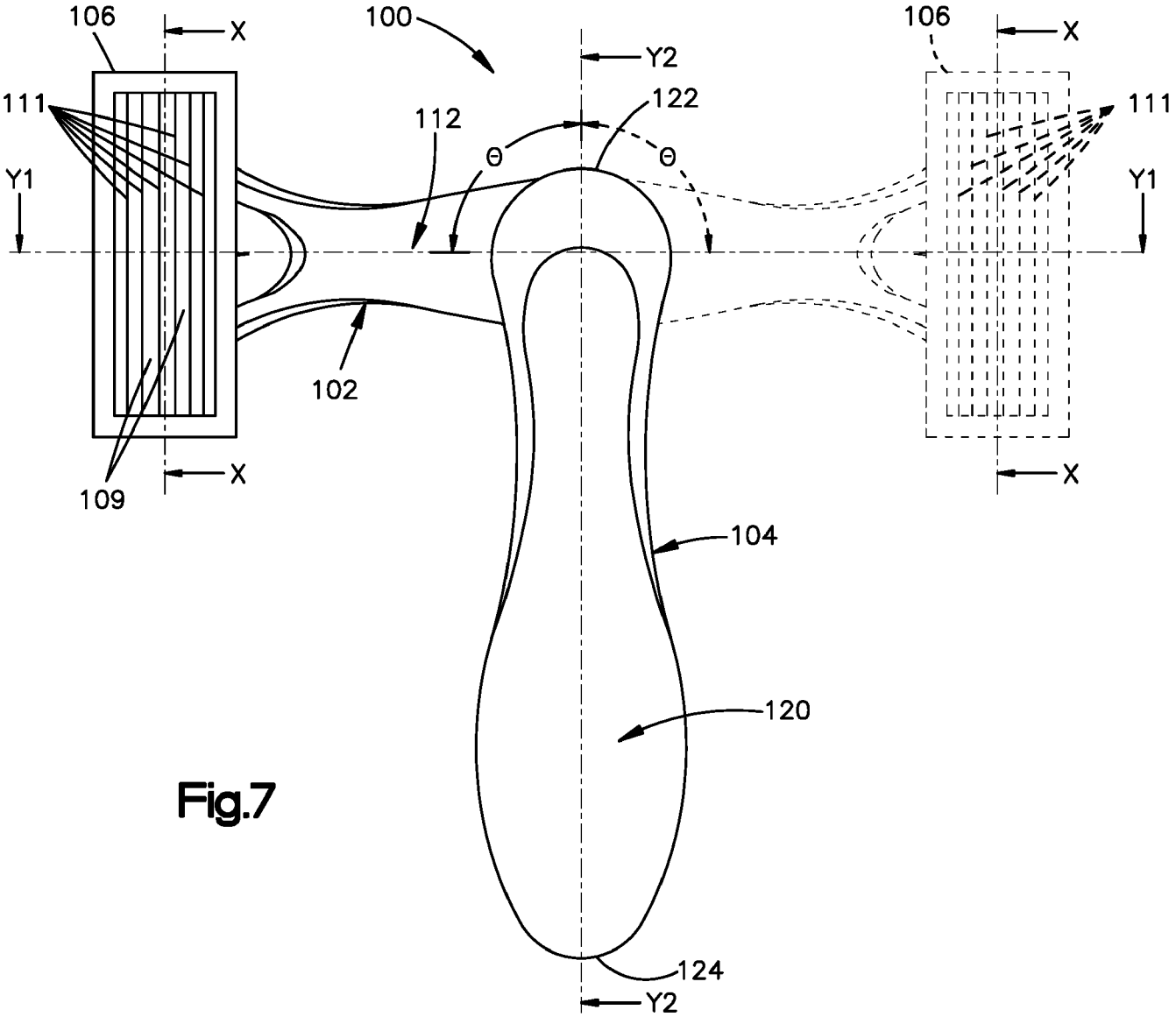
FIG. 7 is a top plan view of the shaving razor of FIG. 1 in another configuration.
Figure 8:
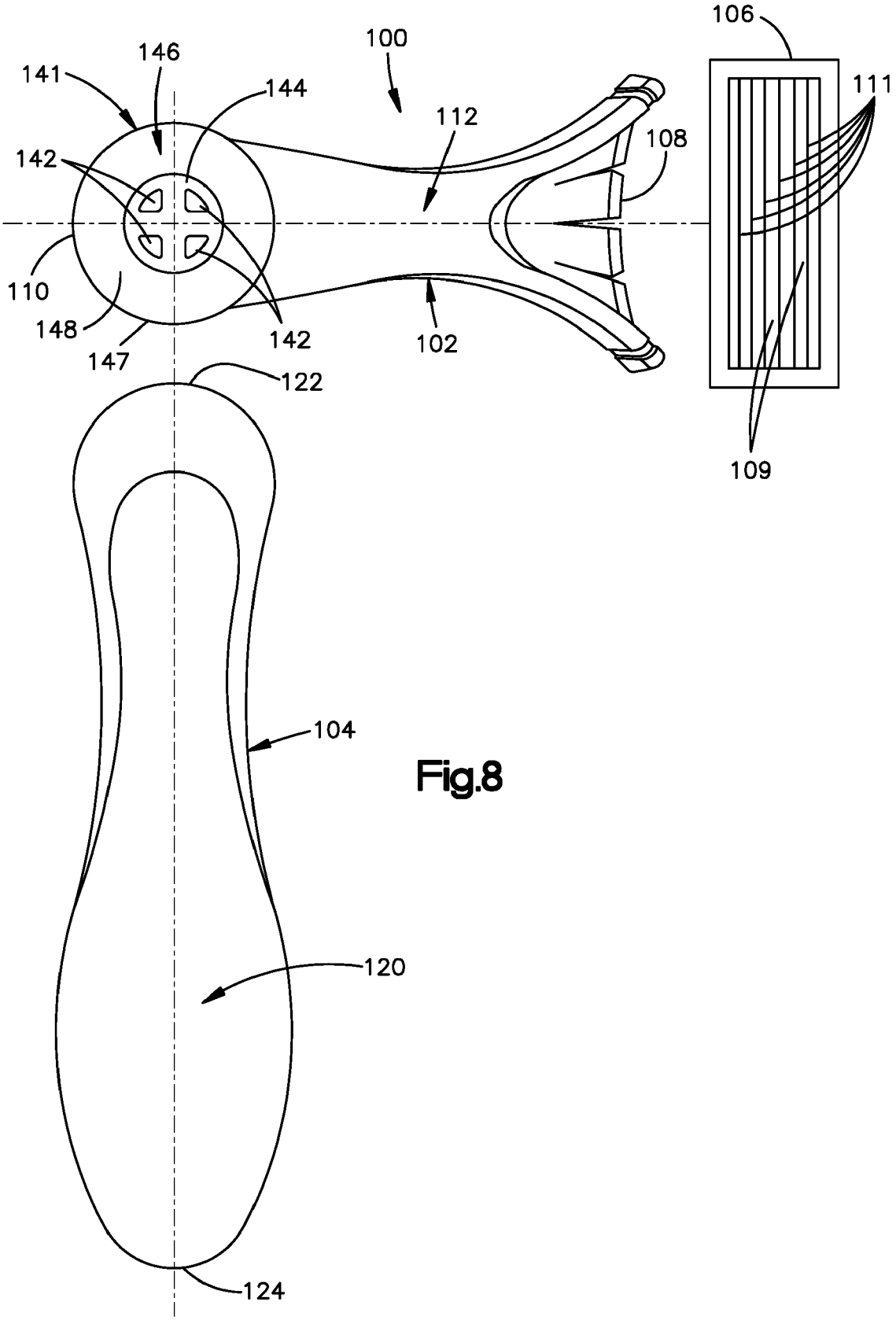
FIG. 8 is an exploded top plan view of the shaving razor of FIG. 7.

On the lower end component 104, the connector 140 includes a second connecting portion or female portion 150 adjacent to the end 122 of the lower end component 104. The female portion 150 includes an aperture 154 that partially extends into the lower end component 104 and is positioned on a depressed lower platform 156 that extends into a lower base 158 of the female portion 150. The female portion 150 includes a ledge 160, which extends entirely around the base 158 and defines an outermost edge of a lower abutment surface 162 of the female portion 150. The aperture 154 is sized and shaped to snugly receive the plurality of arms 142 of the male portion 141 so that the plurality of arms 142 are rotatably and removably secured therein, thereby providing a friction-fit engagement therebetween. In the exemplary embodiment, the aperture 154 is circular. It is foreseen, however, that the aperture 154 may be of any shape to correspond with a shape of the plurality of arms 142, e.g., oval, rectangle, square, or a combination thereof, without deviating from the scope of the present disclosure. The rotatable connection between the components 102, 104 via the connector 140 allows the components 102, 104 to articulate, e.g., tilt, pivot, or rotate, relative to each other. In this manner, the shaving razor 100 can be selectively positioned in a variety of different use configurations about the axis rotation defined by the male portion 141. In the exemplary embodiment, the connector 140 allows the component 102, 104 to rotate 360 degrees relative to each other from a generally aligned configuration of the components 102, 104, i.e., 0 degrees as illustrated by FIGS. 3, 4, wherein the first axis Y1 and the second axis Y2 are collinear. It is foreseen that the connector 140 may include one or more locking components operable to lock the components 102, 104 at one or more various degrees relative to each other, wherein the first axis Y1 and the second axis Y2 are angularly spaced by a rotation angle θ and wherein the first axis Y1 and the second axis Y2 are no-collinear, e.g., at 90 degrees as illustrated by FIG. 5, at −90 degrees relative to each other as illustrated by FIG. 7, at 45 degrees, and/or at −45 degrees without deviating from the scope of the present disclosure. A rotation axis Z is perpendicular to the first axis Y1 and the second axis Y2. The rotation angle θ is about the rotation axis Z.

When the shaving razor 100 is in the use configuration as illustrated by FIG. 1, the plurality of arms 142 are entirely nested within the aperture 154 with the upper platform 144 nested within the female portion 150 and abutting the lower platform 156 and the upper base 146 abutting the lower base 158 such that the platforms 144, 156 and bases 146, 158 are entirely concealed by each other. Further, when the plurality of arms 142 are nested within the aperture 154, the ledges 147, 160 are generally aligned with each other thereby providing a generally continuous surface between the components 102, 104 at the connector 140.

The plurality of arms 142 are formed of a resilient material, e.g., plastic, which allows each of the plurality of arms 142 to independently bend, e.g., toward or away from each other, upon application of a force and return to an original configuration upon removal of the force. The resilient nature of the plurality of arms 142 facilitates conversion of the shaving razor 100 to and from the configurations illustrated in FIGS. 1, 2. For instance, during attachment of the upper end component 102 to the lower end component 104, the components 102, 104 are aligned in a parallel direction so that the plurality of arms 142 are aligned with the aperture 154. Upon application of a force, e.g., a force applied on one of the components 102, 104 to bias the one of the components 102, 104 toward another one of the components 102, 104, one or more of the plurality of arms 142 are caused to bend toward each other, thereby allowing the plurality of arms 142 to extend further into the aperture 154. The shaving razor 100 is designed such that the plurality of arms 142 extend into the aperture 154 until: (1) the plurality of arms 142 are entirely nested within the aperture 154; and (2) the abutment surfaces 148, 162 abuttingly engage each other, all of which generally occur simultaneously, thereby providing a resilient snap-fit engagement between the components 102, 104. The plurality of arms 142 are secured within the aperture 154 such that inadvertent separation of the components 102, 104 is prevented unless another force is applied on one or both of the components 102, 104. In the exemplary embodiment, the another force is equal to and in an opposite direction of the force applied to attach the components 102, 104. It is foreseen that the components 102, 104 may be connected via one or more other connecting elements to provide locking functionality and/or rotating functionality therebetween without deviating from the scope of the present disclosure. For instance, the connector 140 could operate using a spring or an elongated rubber element that extends from one of the components 102, 104 and is securely received by another one of the components 102, 104, e.g., in an aperture of the another one of the components 102, 104, thereby providing locking functionality therebetween. In such an embodiment, the rubber element is elastically deformed to provide movement or rotating functionality of the components 102, 104 relative to each other. A security pin may be provided that is removably installed entire through one of the components 102, 104 and at least partially through another one of the components 102, 104, thereby allowing the components 102, 104 to be fixed in one or more positions relative to each other when the security pin is extended therethrough.

To detach the components 102, 104 from each other, the another force is applied, e.g., on one of the components 102, 104 to bias the one of the components 102, 104 away from another one of the components 102, 104. The another force causes one, or more, of the plurality of arms 142 to bend away from each other, thereby allowing the plurality of arms 142 to be removed from the aperture 154.

When the shaving razor 100 is in the configuration illustrated in FIG. 1, the grip 120 can be utilized by the user to guide the shaving head 106 across a surface, e.g., skin, of the user, thereby allowing the plurality of blades 109 to contact and sever hair on the surface of the user. Additionally, the user may utilize the rotatable connection between the components 102, 104 via the connector 140 and tilt, pivot, or rotate the components 102, 104 relative to each other based on preferences of the user, e.g., to optimize precision and/or handling of the razor 100 on a surface of the user that is difficult to reach and is easier to reach when the components 102, 104 are pivoted or rotated relative to each other. In this manner, the shaving razor 100 can be selectively positioned in a variety of different use configurations while the components 102, 104 are secured together as illustrated in FIG. 1. Alternatively, the user may reconfigure the shaving razor 100 to the configuration illustrated in FIG. 2 by removing the lower end component 104 from the upper end component 102, as previously discussed, and utilize the grip 112 to guide the shaving head 106 across the surface of the user, thereby allowing the plurality of blades 109 to contact and sever hair on the surface of the user. The various configurations of the shaving razor 100 can be strategically utilized based on personal preferences of the user. For instance, the user might desire to utilize one or more of the various configurations of the shaving razor 100 to shave different body parts, e.g., one or more body parts that are difficult to reach using a conventional shaving razor. Indeed, the variability and adaptability provided by the various configurations of the shaving razor 100 of the present disclosure overcome the difficulties of conventional shaving razors by providing, among other things, better maneuverability to the user. For instance, the shaving razor 100 of the present disclosure provides the user with easier access to body parts that are difficult to reach where, with a non-articulating shaver, such would be difficult or impossible to reach. Further, the various configurations of the shaving razor 100 of the present disclosure advantageously improves of the ability to grip the handle 110, 120 for use with different body parts. Or, the user might desire to utilize one or more of the various configurations of the shaving razor 100 based on storage availability for storing the shaving razor 100, e.g., in a suitcase or travel bag.

Figure 9:
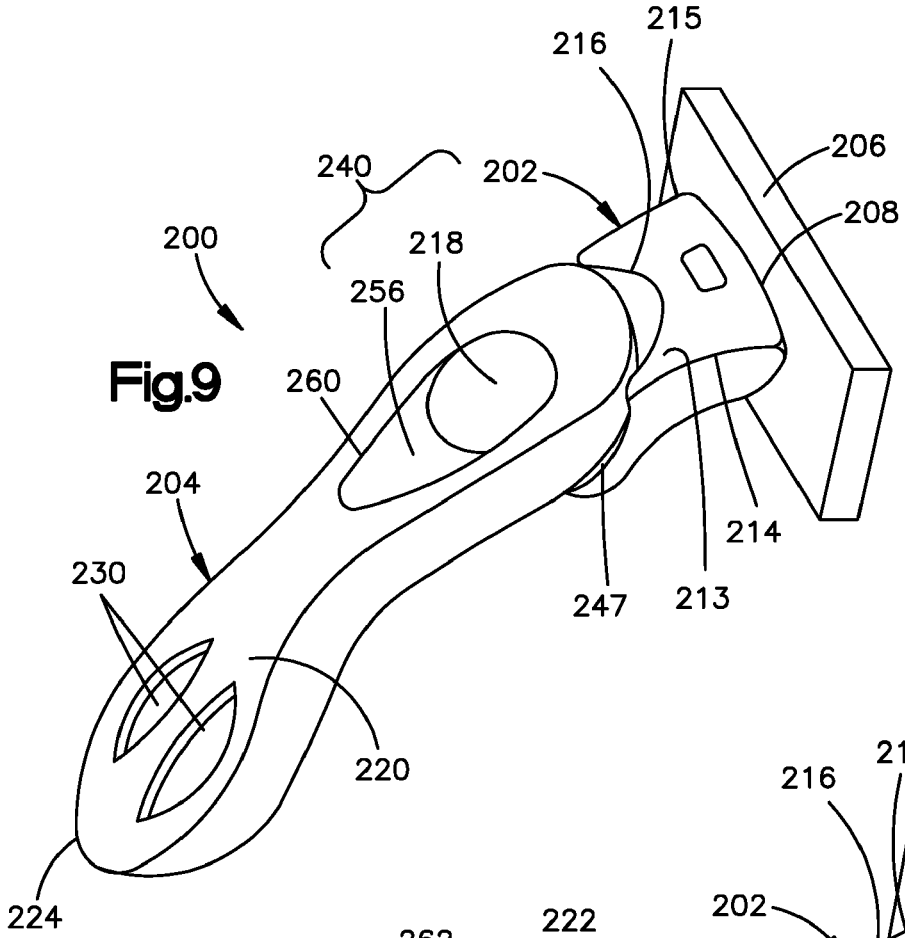
FIG. 9 is a diagram illustrating a perspective view of a shaving razor with a first handle detachably secured to a second handle.
Figure 10:
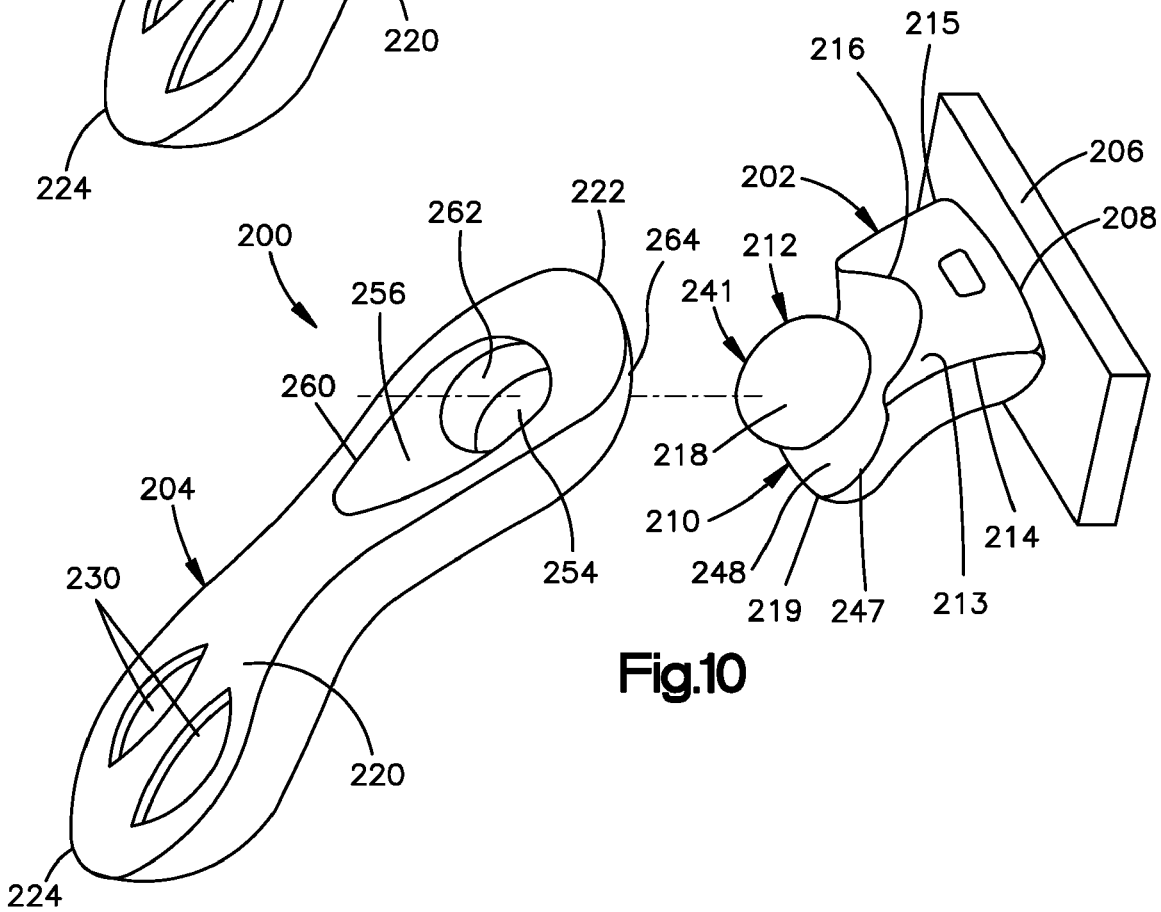
FIG. 10 is a diagram illustrating a perspective view of the shaving razor shown in FIG. 9 with the first handle detached from the second handle.

Turning to FIGS. 9-12, another embodiment of the present disclosure is illustrated with a shaving razor 200. Similar to the shaving razor 100, the shaving razor 200 generally includes a body with two elongated components, i.e., an upper end component 202 and a lower end component 204, that are detachably secured together to provide a plurality of different use configurations as illustrated by FIGS. 9, 10. In this embodiment, an overall size of the upper end component 202 is smaller than that of the lower end component 204. The upper end component 202 is sized, shaped, and operable to function as a miniature or pocket-side handle to facilitate use of the shaving razor 200 when the upper end component 202 is detached from the lower end component 204. The lower end component 204 is sized, shaped, and operable to function as an extension handle to facilitate use of the shaving razor 100 when the upper end component 202 is attached to the lower end component 204. The upper end component 202 includes a shaver head 206 secured to an end 208 that is opposite to the lower end component 204. In the exemplary embodiment, the shaver head 206 is permanently secured to the upper end component 202, with a fixed orientation thereto, but it is foreseen that the shaver head 206 may be detachably secured to the upper end component 202 and/or pivotably or rotatably secured to the upper end component 202 without deviating from the scope of the present disclosure. The shaver head 206 houses a plurality of blades 209 and preferably includes at least one and up to ten blades. It is foreseen that the shaving head 206 may include a plurality of additional components, e.g., a guard bar and a cap, on either side of the plurality of blades 209, a lubrication strip, and/or a plurality of fins without deviating from the scope of the present disclosure.

Opposite to the end 208 of the upper end component 202 is a rounded end 210 that forms a portion of a handle or grip 212. It is foreseen that the end 210 of the upper end component 202 could be any shape, e.g., cylindrical, without deviating from the scope of the present disclosure. The grip 212 is defined by exterior surfaces of a plurality of intersecting features with different contours that collaboratively allow a user of the shaving razor 200 to securely grip and handle, or manipulate the shaving razor 200 when the shaving razor 200 is in another use configuration as illustrated by FIG. 10. The grip 212 includes a planar surface 213 with shoulders 214, 215 on sides thereof. Each of the shoulders 214, 215 extends along the upper end component 202 from the shaver head 206 and the end 208, and to an approximate midpoint of the upper end component 202. The surface 213 includes an edge 216, which extends between the shoulders 214, 215 on the upper end component 102. The edge 216 has a curvature and also forms part of the grip 212. Between the edge 216 and the end 210 is a raised surface 218 that also forms part of the grip 212 and part of the end 210. In the exemplary embodiment, the raised surface 218 is dome shaped, generally annular, and defines an axis of rotation. It is foreseen, however, that the raised surface 218 may be formed in one or more other shapes including, but not limited to, oval, rectangle, square, or a combination thereof, without deviating from the scope of the present disclosure. The raised surface 218 extends from a platform 219, which defines the rounded end 210.

The lower end component 204 includes another handle or grip 220. Similar to the grip 212 of the upper end component 202, the grip 220 is defined by exterior surfaces of a plurality of intersecting features with different contours that collaboratively allow the user of the shaving razor 200 to securely grip and handle, or manipulate, the shaving razor 200 when the shaving razor 200 is in the use configuration as illustrated by FIG. 9. The grip 220 extends along an entire length of the lower end component 204 and between a rounded end 222 and an end 224 of the lower end component 204.

In the exemplary embodiment, the lower end component 204 includes a plurality of friction-enhancing surface features 230 formed on a portion of the grip 220. The friction-enhancing surface features 230 provide a surface texture that improves the ability to grip the shaving razor 200 via the grip 220. Although the friction-enhancing surface features 230 are only illustrated on the portion of the grip 220, it is foreseen that the friction-enhancing surface features 230 may be formed on one or more other portions of the upper and/or lower end components 202, 204 without deviating from the scope of the present disclosure.

A connector 240 is formed on a portion of each of the upper end component 202 and the lower end component 204. On the upper end component 202, the connector 240 includes a male portion 241 adjacent to the end 210 of the upper end component 202. The male portion 241 includes a ledge 247, which extends partially around the platform 219 and defines an outermost edge of an upper abutment surface 248 of the male portion 241. The male portion 241 further includes the raised surface 218.

Figure 11:
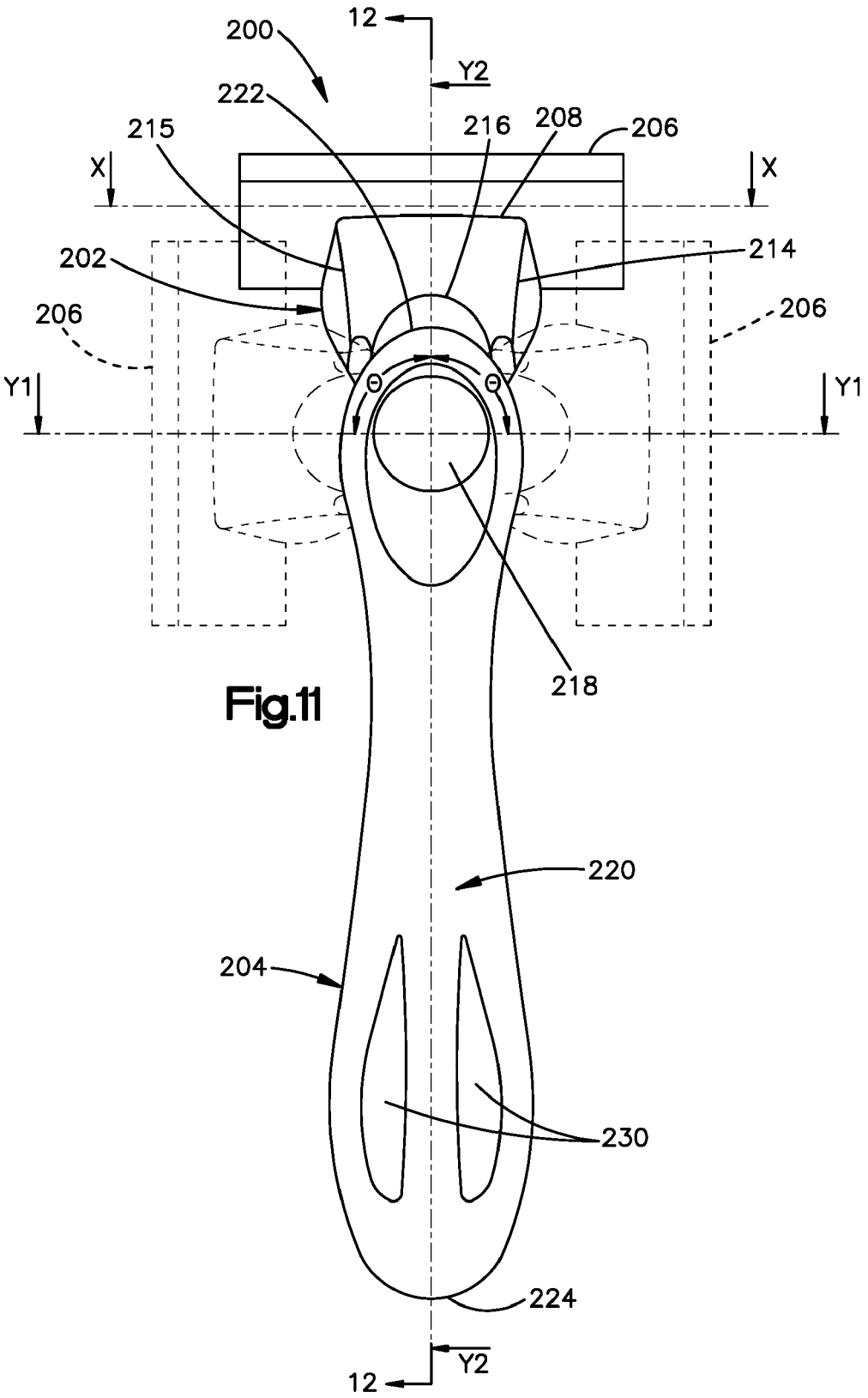
FIG. 11 is a diagram illustrating a top plan view of the shaving razor shown in FIG. 9 with the first handle detachably secured to the second handle.
Figure 12:
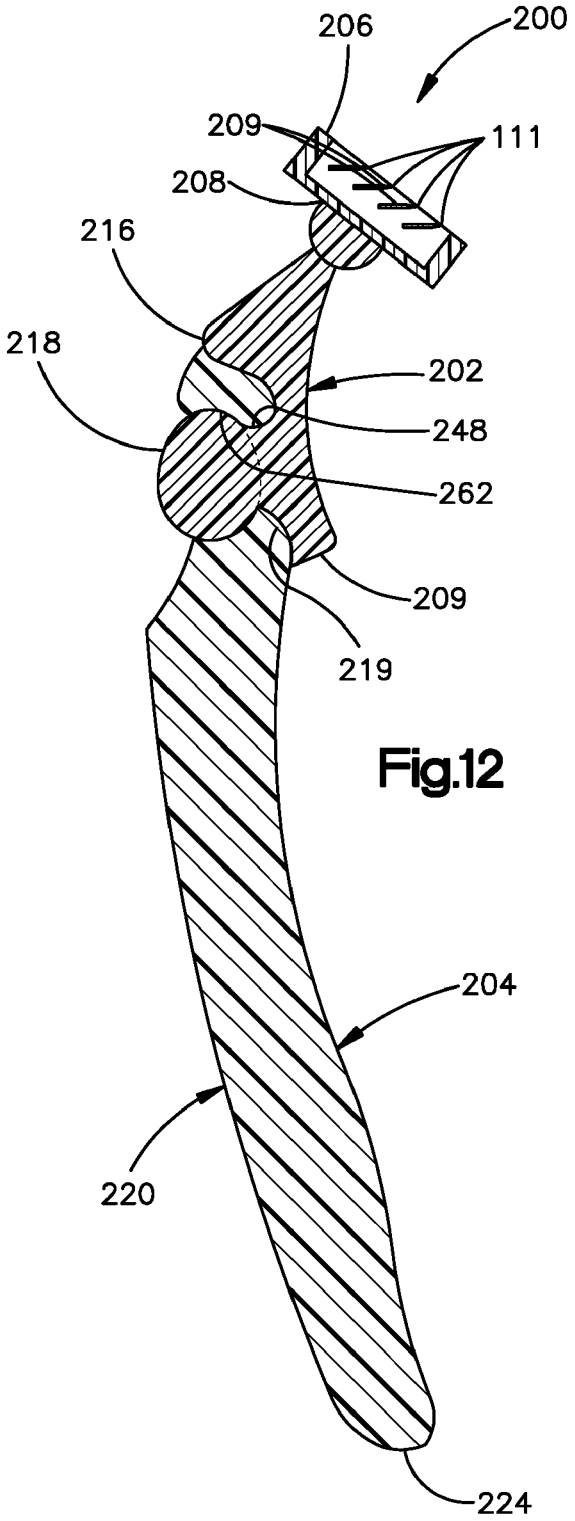
FIG. 12 is a diagram illustrating a cross-sectional side plan view of the shaving razor shown in FIG. 11 along line 12-12.

On the lower end component 204, the connector 240 includes a female portion 250 adjacent to the end 222 of the lower end component 204. The female portion 250 includes an aperture 254 that extends through the lower end component 204 and adjoins with a depression 256 that partially surrounds the aperture 254 of the female portion 250. The female portion 250 includes a ledge 260, which extends entirely around the aperture 254 and the depression 256. The aperture 254 includes a lower interior abutment surface 262 of the female portion 250 and is sized and shaped to snugly receive the raised surface 218 so that the raised surface 218 is rotatably and removably secured therein. In the exemplary embodiment, the aperture 254 is circular. It is foreseen, however, that the aperture 254 may be of any shape to correspond with a shape of the raised surface 218, e.g., oval, rectangle, square, or a combination thereof, without deviating from the scope of the present disclosure. The rotatable connection between the components 202, 204 via the connector 240 allows the components 202, 204 to tilt or pivot relative to each other. In this manner, the shaving razor 200 can be selectively positioned in a variety of different use configurations as illustrated by FIG. 11.

When the shaving razor 200 is in the use configuration as illustrated by FIG. 9, the raised surface 218 extends entirely through the aperture 254 and is partially exposed on an upper side of the aperture 254, and an entirety of the lower interior abutment surface 262 is abuttingly engaged to only a portion of the upper interior abutment surface 248 so that the lower interior abutment surface 262 is entirely concealed by the portion of the upper interior abutment surface 248. Further, when the raised surface 218 is secured within the aperture 254, a lower exterior abutment surface 264 abuts another portion of the upper interior abutment surface 248. In this manner, the lower end component 204 is partially nested within the upper end component 202 when the raised portion 218 is secured within the aperture 254.

The raised surface 218 is formed of a resilient material, e.g., rubber, which allows the raised surface 218 to compress, upon application of a force and return to an original configuration upon removal of the force. The resilient nature of the raised surface 218 facilitates conversion of the shaving razor 200 to and from the configurations illustrated in FIGS. 9, 10. For instance, during attachment of the upper end component 202 to the lower end component 204, the components 202, 204 are aligned in a parallel direction so that the raised surface 218 is aligned with the aperture 254. Upon application of a force, e.g., a force applied on one of the components 202, 204 to bias the one of the components 202, 204 toward another one of the components 202, 204, one or more of the raised surfaces 218 is caused to compress, thereby allowing the raised surface 218 to extend further into the aperture 254. The shaving razor 200 is designed such that the raised surface 218 extends into the aperture 254 until: (1) the raised surface 218 is substantially extended through the aperture 254; and (2) the end 222 of the portion 204 is extended into and nested on the platform 219 and between the raised surface 218 and the edge 216 of the portion 202; and (3) the abutment surfaces 248, 262, 264 are abuttingly engaged to each other, all of which generally occur simultaneously, thereby providing a resilient snap-fit engagement between the components 202, 204. The raised surface 218 is secured within the aperture 254 such that inadvertent separation of the components 202, 204 is prevented unless another force is applied on one or both of the components 202, 204. In the exemplary embodiment, the another force is equal to and in an opposite direction of the force applied to attach the components 202, 204.

To detach the components 202, 204 from each other, the another force is applied, e.g., on one of the components 202, 204 to bias the one of the components 202, 204 away from another one of the components 202, 204. The another force causes the raised surface 218 to compress, thereby allowing the raised surface 218 to be removed from the aperture 254.

When the shaving razor 200 is in the configuration illustrated in FIG. 9, the grip 220 can be utilized by the user to guide the shaving head 206 across a surface, e.g., skin, of the user, thereby allowing the plurality of blades 209 to contact and sever hair on the surface of the user. Additionally, the user may utilize the rotatable connection between the components 202, 204 via the connector 240 and articulate, e.g., tilt, pivot, or rotate, the components 202, 204 relative to each other based on preferences of the user, e.g., to optimize precision and/or handling of the razor 200 on a surface of the user that is difficult to reach and is easier to reach when the components 202, 204 are pivoted or rotated relative to each other. In this manner, the shaving razor 200 can be selectively positioned in a variety of different use configurations about the axis of rotation defined by the male portion 241 while the components 202, 204 are secured together as illustrated in FIG. 9. In the exemplary embodiment, the connector 240 allows the component 202, 204 to rotate from a generally aligned configuration of the components 202, 204, i.e., 0 degrees, as illustrated by FIG. 11, to a maximum of 90 degrees in either direction, i.e., 0 degrees to 90 degrees and 0 degrees to −90 degrees. The ledge 247 of the upper component 102 is operable to abuttingly engage the lower component 204 when the components 202, 204 are rotated in opposite directions. In this manner, the ledge 247 defines a maximum degree of rotation of the components 202, 204 of approximately 180 degrees. It is foreseen that the connector 240 may include one or more locking components operable to lock the components 202, 204 at one or more various degrees relative to each other without deviating from the scope of the present disclosure.

Alternatively, the user may reconfigure the shaving razor 200 to the configuration illustrated in FIG. 10 by removing the lower end component 204 from the upper end component 202, as previously discussed, and utilize the grip 212 to guide the shaving head 206 across the surface of the user, thereby allowing the plurality of blades 209 to contact and sever hair on the surface of the user. The various configurations of the shaving razor 200 can be strategically utilized based on personal preferences of the user. For instance, the user might desire to utilize one or more of the various configurations of the shaving razor 200 to shave different body parts, e.g., one or more body parts that are difficult to reach using a conventional shaving razor. Indeed, the variability and adaptability provided by the configurations of the shaving razor 200 of the present disclosure overcome the difficulties of conventional shaving razors by providing, among other things, better maneuverability to the user. For instance, the shaving razor 200 provides the user with easier access to body parts that are difficult to reach where, with a non-articulating shaver, such would be difficult or impossible to reach. Further, the various configurations of the shaving razor 200 advantageously improves the ability of a user to grip of the handle 212, 220 for use on different body parts. Alternatively, the user might desire to utilize one or more of the various configurations of the shaving razor 200 based on storage availability for storing the shaving razor 200, e.g., in a suitcase or travel bag.

One of skill in the art will recognize that the described examples are not limited to any particular size. Further, one of skill in the art will recognize that the components of the shaving razors 100, 200 are not limited to any type of material. In a preferred example, the shaving razor, e.g., any one or more of the shaving razors 100, 200 is formed of one or more plastics and/or rubber, but may be formed of a variety of different materials including metal or the like, or a combination thereof. One skilled in the art will recognize that different diameters, types, and thicknesses of preferred materials can be utilized when taking into consideration design and stability considerations. A number of manufacturing techniques may be used such as the molding, machining, and/or casting one or more components of the shaving razor. An example process of manufacturing the shaving razors 100, 200 includes use of an injection molding process or other like manufacturing means.

The above disclosed first use configuration corresponds to a standard shaving configuration. The standard shaving configuration means the pocket-size handle is removably and rotatably secured to the extension handle via the connection means. Thus, in the standard shaving configuration, the first axis Y1 and the second axis Y2 are collinear. The overall dimension of the handle, comprising the pocket-size handle and the extension handle, along a longitudinal direction, is comprised between 10 cm and 20 cm. Furthermore, the above disclosed third use configuration corresponds to a first non-standard shaving configuration. The first non-standard shaving configuration means the pocket-size is detached from the extension handle. Thus, the extension handle is not used by a user in this non-conventional shaving configuration. The dimension of the pocket-size handle along a longitudinal direction is comprised between 2 cm and 7 cm. In addition, the second use configuration disclosed above corresponds to a second non-standard shaving configuration. The second non-standard shaving configuration means the pocket-size handle and the extension handle are attached by the connecting means and the first axis Y1 and the second axis Y2 are no-collinear. Therefore, in this second non-standard shaving configuration, the first axis Y1 and the second axis Y2 are angularly spaced by a rotation angle θ.

It will be appreciated by those skilled in the art that changes could be made to the embodiments described above without departing from the broad concept thereof. It is understood, therefore, that the present concept disclosed herein is not limited to the particular embodiments disclosed and is intended to cover modifications within the spirit and scope of the present disclosure.

What is claimed is:

1. A shaving razor operable to be used in various configurations, the shaving razor comprising:

a first portion including a first end and an opposing second end, the first end having a head containing at least one blade extending along a blade axis and the second opposing end including a first connector, the first portion extending along a first axis which is perpendicular to the blade axis, the first portion including a first handle between the head and the first connector;

a second portion including a second handle extending between a first end and a second end and defining a longitudinal axis, the first end including second connector, the second portion extending along a second axis, wherein when the first portion is connected with the second portion, the second handle of the second portion functions as an extension handle to the first handle;

the first connector being operably received to fully nest within an interior of the second connector;

the first connector and the second connector being operable to facilitate rotation of the first portion and the second portion with respect to each other along a plane substantially parallel with the blade axis and to lock the first portion and the second portion in position with respect to each other, wherein the first handle and the second handle are aligned by the first connector and the second connector such that the first axis and the second axis extend in (i) a parallel direction in a first use configuration, and (ii) a non-parallel direction in a second use configuration, and wherein the first and the second connectors are operable to permit the first handle to detach from the second handle to provide a third use configuration where the first portion functions as the shaving razor.

2. The shaving razor according to claim 1, wherein the first connector includes a male portion and the second connector includes a female portion, and the female portion is operable to at least partially receive the male portion.

3. The shaving razor according to claim 2, wherein the female portion includes an aperture that extends at least partially through the second handle.

4. The shaving razor according to claim 3, wherein the male portion includes (i) at least one arm operable to be received in the aperture, or (ii) a dome operable to be received in the aperture to lock the first portion in position with respect to the second portion.

5. The shaving razor according to claim 4, wherein the male portion includes a circumferential abutment surface at least partially surrounding the at least one arm or the dome.

6. The shaving razor according to claim 4, wherein the at least one arm or the dome defines an axis of rotation, the first portion and the second portion being operable to rotate about the axis of rotation.

7. The shaving razor according to claim 1, wherein at least a portion of the first connector is resilient, and the first connector is operable to detachably secure the first portion to the second portion via a friction-fit engagement.

8. The shaving razor according to claim 1, wherein the first connector provides a pivot range between the first portion and the second portion, the first portion and the second portion being selectively positioned in a plurality of configurations for different uses.

9. The shaving razor according to claim 8, wherein the pivot range is between 0 and 90 degrees where 0 degrees is defined at a position when the first portion extends perpendicular to the second handle.

10. The shaving razor according to claim 8, wherein the pivot range is between 0 and −90 degrees where 0 degrees is defined at a position when the first portion extends perpendicular to the second handle.

11. A reconfigurable shaving razor comprising:

a first component including a shaver head containing at least one blade extending along a blade axis, a first gripping surface extending along a first axis perpendicular to the blade axis, and a first portion of a connector; and a second component including a second gripping surface extending along a second axis and a second portion of the connector, wherein when the first portion of the connector is connected with the second portion, the second gripping surface of the second component functions as an extension handle to the first component;

the first portion of the connector is operable to allow the first component to rotate with respect to the second component along a plane substantially parallel with the blade axis and assume a plurality of configurations while the first component is secured to the second component and the first portion of the connector is operable to lock the first component in position with respect to the second component, wherein the first gripping surface and the second gripping surface are aligned by the connector such that the first axis and the second axis extend in (i) a parallel direction in a first use configuration, and (ii) a non-parallel direction in a second use configuration, and wherein the first portion and the second portion of the connector are operable to permit the first component to detach from the second component to provide a third use configuration where the first component functions as the shaving razor.

12. The shaving razor of claim 11, wherein the connector facilitates a pivot range between the first component and the second component.

13. The shaving razor of claim 12, wherein the pivot range is between 0 and 90 degrees, and 0 and −90 degrees, where 0 degrees is defined at a position when the first component extends parallel to the second component.

14. The shaving razor of claim 11, wherein the first portion of the connector is a male portion, and the second portion of the connector is a female portion, an end of the male portion is operable to nest within a portion of the female portion.

15. The shaving razor of claim 14, wherein the female portion includes an interior abutment surface and an exterior abutment surface, and the male portion includes a surface operable to abut the interior abutment surface and the exterior abutment surface of the female portion.

16. The shaving razor of claim 15, wherein the male portion (i) defines an axis of rotation, and (ii) includes a ledge that defines a maximum limit of the axis of rotation.

17. A shaving razor comprising:

a first component including (i) a first component end with a shaver head containing at least one blade extending along a blade axis, (ii) another first component end with a portion of a connector extending from the first component, and (iii) a first elongated gripping surface extending between the first component end and the another first component end along a first axis;

a second component including (i) a second component end with an aperture extending at least partially through the second component, and (ii) a second elongated gripping surface extending between the second component end and another second component end extending along a second axis; and wherein the portion of the connector is operable to (i) rotatably secure the first component to the second component such that the first component rotates with respect to the second component along a plane substantially parallel with the blade axis, (ii) allow the first component to assume a plurality of use configurations while the first component is secured to the second component, wherein the first elongated gripping surface and the second elongated gripping surface are aligned by the connector such that the first axis and the second axis extend in (i) a parallel direction in a first use configuration, and (ii) a non-parallel direction in a second use configuration (iii) lock the first component in place with respect to the second component when positioned in each of the plurality of use configurations, and (iv) allow the first component to assume another use configuration where the first component functions as the shaving razor while the first component is separated from the second component.

* * * * *